US006373037B1

(12) United States Patent
Brown et al.

(10) Patent No.: US 6,373,037 B1
(45) Date of Patent: Apr. 16, 2002

(54) OVEN CAVITY CONSTRUCTION FOR CONVECTION COOKING APPLIANCE

(75) Inventors: John Scott Brown; William Edward Jay, both of Charleston, TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/649,957

(22) Filed: Aug. 29, 2000

Related U.S. Application Data

(60) Provisional application No. 60/153,219, filed on Sep. 13, 1999.

(51) Int. Cl.[7] ..... H05B 6/80; H05B 6/76

(52) U.S. Cl. ..... 219/681; 219/400; 219/738; 219/756; 219/757; 126/21 A; 174/35 GC

(58) Field of Search ..... 219/681, 682, 219/683, 684, 699, 736, 738, 741, 400, 401, 756, 757; 126/21 R, 21 A; 99/451, 468, 474, 467, 330, 325; 174/35 GC

(56) References Cited

U.S. PATENT DOCUMENTS

| | | | | | |
|---|---|---|---|---|---|
| 3,258,850 | A | * | 7/1966 | Swanson | 219/400 |
| 3,629,538 | A | | 12/1971 | Suzuki | |
| 3,668,357 | A | | 6/1972 | Kobayashi | |
| 3,733,455 | A | | 5/1973 | Foerstner et al. | |
| 3,736,399 | A | | 5/1973 | Jarvis | |
| 4,081,647 | A | | 3/1978 | Torrey | |
| 4,205,256 | A | | 9/1982 | Oguro | |
| 4,350,859 | A | | 9/1982 | Dudley et al. | |
| 4,412,117 | A | | 10/1983 | Dudley et al. | |
| 4,659,891 | A | | 4/1987 | Yamaguchi et al. | |
| 4,728,762 | A | * | 3/1988 | Roth et al. | 219/681 |
| 4,817,509 | A | * | 4/1989 | Erickson | 219/400 |
| 4,940,869 | A | * | 7/1990 | Scholtes et al. | 219/681 |
| 5,155,318 | A | | 10/1992 | Bowen | |
| 5,235,150 | A | | 8/1993 | Buske et al. | |
| 5,397,879 | A | | 3/1995 | Geissler | |
| 5,406,932 | A | * | 4/1995 | Joseph et al. | 126/39 K |
| 5,695,673 | A | | 12/1997 | Geissler | |
| 5,874,716 | A | | 2/1999 | Park et al. | |
| 6,060,701 | A | * | 5/2000 | McKee et al. | 219/681 |

* cited by examiner

*Primary Examiner*—Philip H. Leung
(74) *Attorney, Agent, or Firm*—Diederiks & Whitelaw, PLC

(57) ABSTRACT

A convection cooking appliance includes an oven cavity and an air channel assembly that extends about at least a portion of the oven cavity. The air channel assembly includes an air delivery section and a return section, both of which are preferably attached to the oven cavity through a quick latching connection. More specifically, the air delivery section is preferably mounted about an opening in a top wall of the oven cavity through a twist lock arrangement, while the return section is mounted about another opening formed in a bottom wall of the oven cavity also through a twist lock. The overall appliance also incorporates a microwave unit and a metal gasket is interposed at the connections of each of the air delivery section and the return section to the oven cavity in order to provide a continuous ground path between the components in order to contain the microwave energy.

28 Claims, 5 Drawing Sheets

OVEN CAVITY CONSTRUCTION FOR CONVECTION COOKING APPLIANCE

The present application claims priority on U.S. Provisional Application 60/153,219 filed Sep. 13, 1999.

BACKGROUND OF THE INVENTION

1. Field of the Invention

The present invention pertains to the art of cooking appliances and, more particularly, to the construction of an oven cavity preferably having an associated microwave energy source.

2. Discussion of the Prior Art

In a conventional oven arrangement, the oven cavity is typically constituted by an integrated, essentially one-piece unit. With convection cooking appliances, it is necessary to provide both an inlet and an outlet for a developed air flow. In recirculating-type convection systems, the air exiting the oven cavity must be, at least in part, directed back to the inlet through some form of ducting. In order to prevent any undesired loss of recirculating air, it is desired to provide some sealing feature between the ducting and the oven cavity. Typically, the ducting is welded or otherwise fixedly secured to the oven cavity for this purpose.

When a convection cooking appliance is constructed in this fashion, the overall assembly of the appliance can be quite time consuming and costly. Typically, robotic mechanisms are utilized to create the desired welds. Precise alignment of the parts to be joined must be established and maintained to assure that the welds are properly made in order to prevent potential air leakage problems. With such an arrangement, certain design and assembly constraints must be taken into account. When a cooking appliance is to incorporate various heat sources to be selectively used in heating an oven cavity of the appliance, additional design constraints must be taken into consideration. For instance, if the cooking appliance incorporates a microwave energy source, a continuous ground path is needed to contain the microwave energy. Therefore, additional emphasis is placed on the need for consistent and generally uniform welds.

Based on at least the above, it would be desirable to enable the interconnection between an oven cavity and ducting of a convection cooking appliance without requiring precision welding, while also minimizing assembly costs and time. In addition, there exists a need in the art for a convection cooking appliance which incorporates various different types of heat sources, including a microwave heat source, wherein the assembly of the various components of the appliance is carried out in a manner which assures a continuous ground path between the components in order to contain the microwave energy.

SUMMARY OF THE INVENTION

The present invention is directed to forming an oven cavity in a quick and convenient manner. In accordance with the invention, a quick-latching connection, such as a bayonet-type connection, is provided between various panels or portions of an air channel assembly and the walls of the oven cavity. The invention is particularly adapted for use in constructing an oven cavity having an associated microwave source, as well as a blower for directing heated air through a duct that opens into the oven cavity. Provisions are also made to contain microwave radio frequency emissions by incorporating multiple grounding gaskets between the various interconnected components.

More specifically, an upper panel portion defines part of an air channel assembly which leads from the microwave generating source, through the blower and ducting and into the oven cavity. One twist-lock connection is provided between the upper panel portion and upstanding portions of the cavity. An additional twist-locking connection is provided between cavity defining members and an air return assembly located at a bottom section of the oven cavity.

With respect to the gaskets, the most preferred embodiment of the invention incorporates upper and lower gaskets between the top panel and the remainder of the oven cavity, as well as between the air return assembly and the oven cavity, for containing the microwave radio frequency emissions. In the most preferred form, each of the gaskets comprises a circular, fine wire mesh, such as stainless steel, that is captured between the respective components with a compression fit. The wire mesh functions to provide a continuous ground path between the components in order to contain the microwave energy.

Additional objects, features and advantages of the invention will become more fully apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
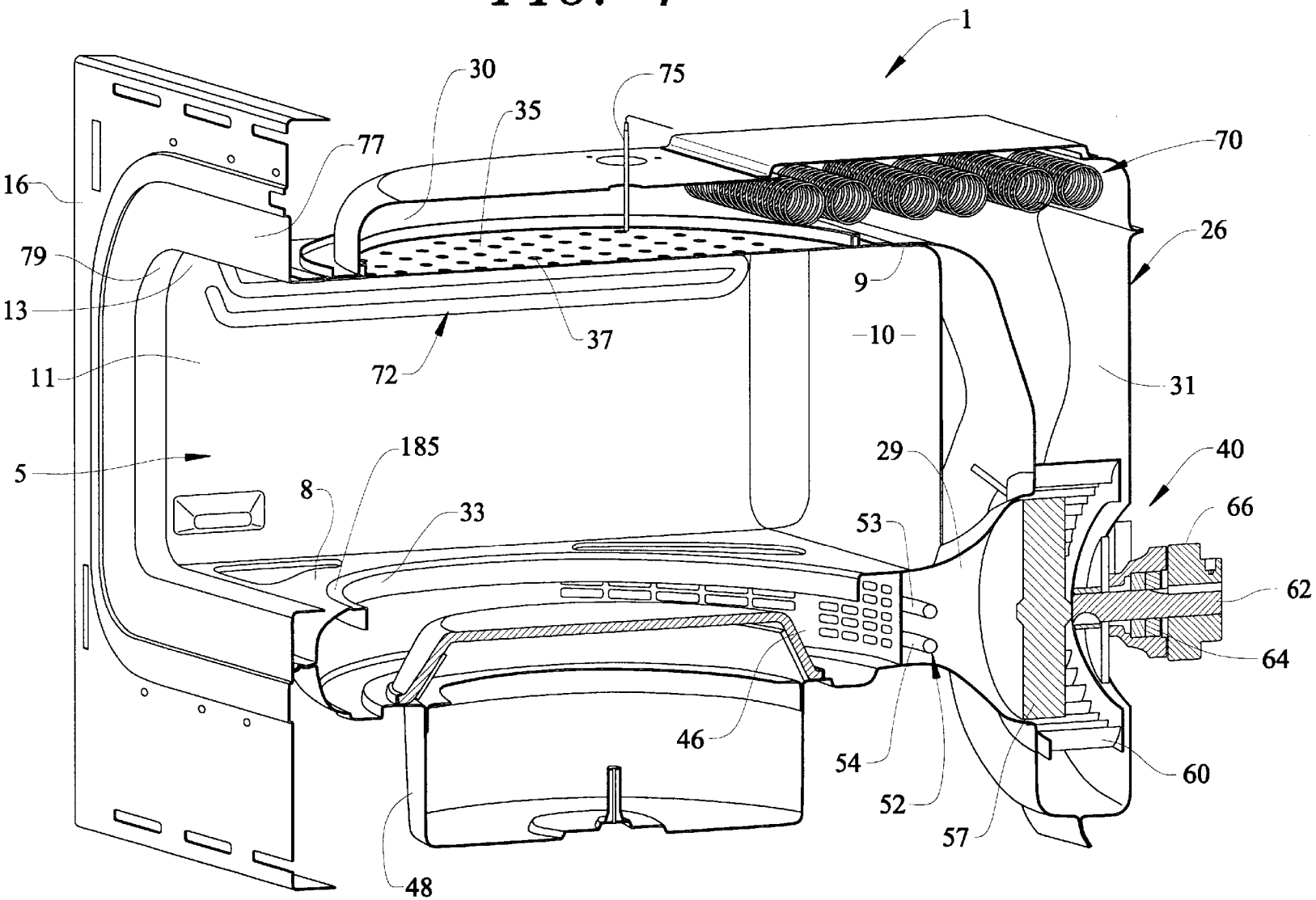
FIG. 1 is a perspective, partial sectional view of a convection cooking appliance including an oven cavity and a surrounding air channel assembly constructed in accordance with the present invention.
Figure 2:
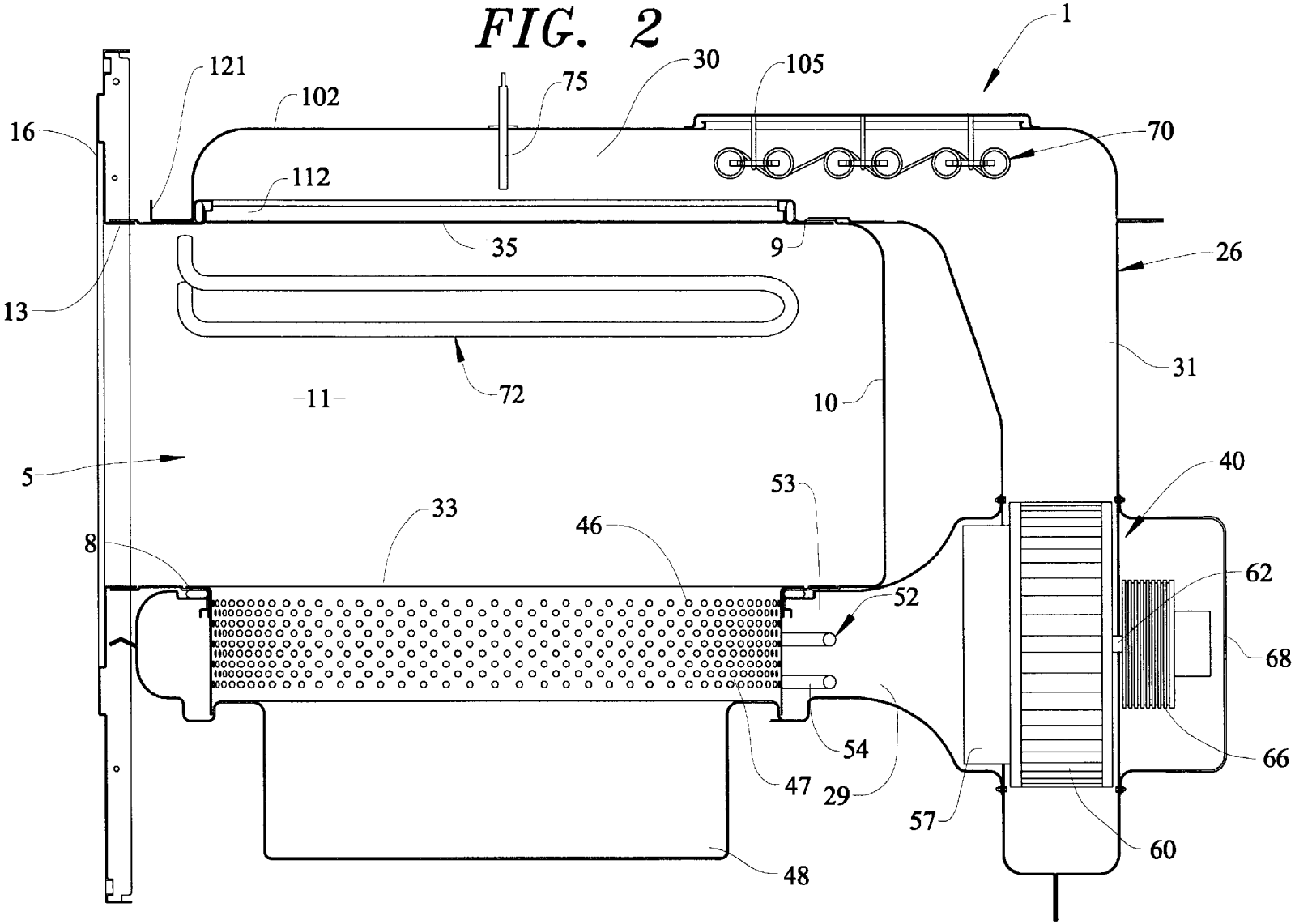
FIG. 2 is a schematic side view of the convection cooking appliance of FIG. 1.
Figure 3:
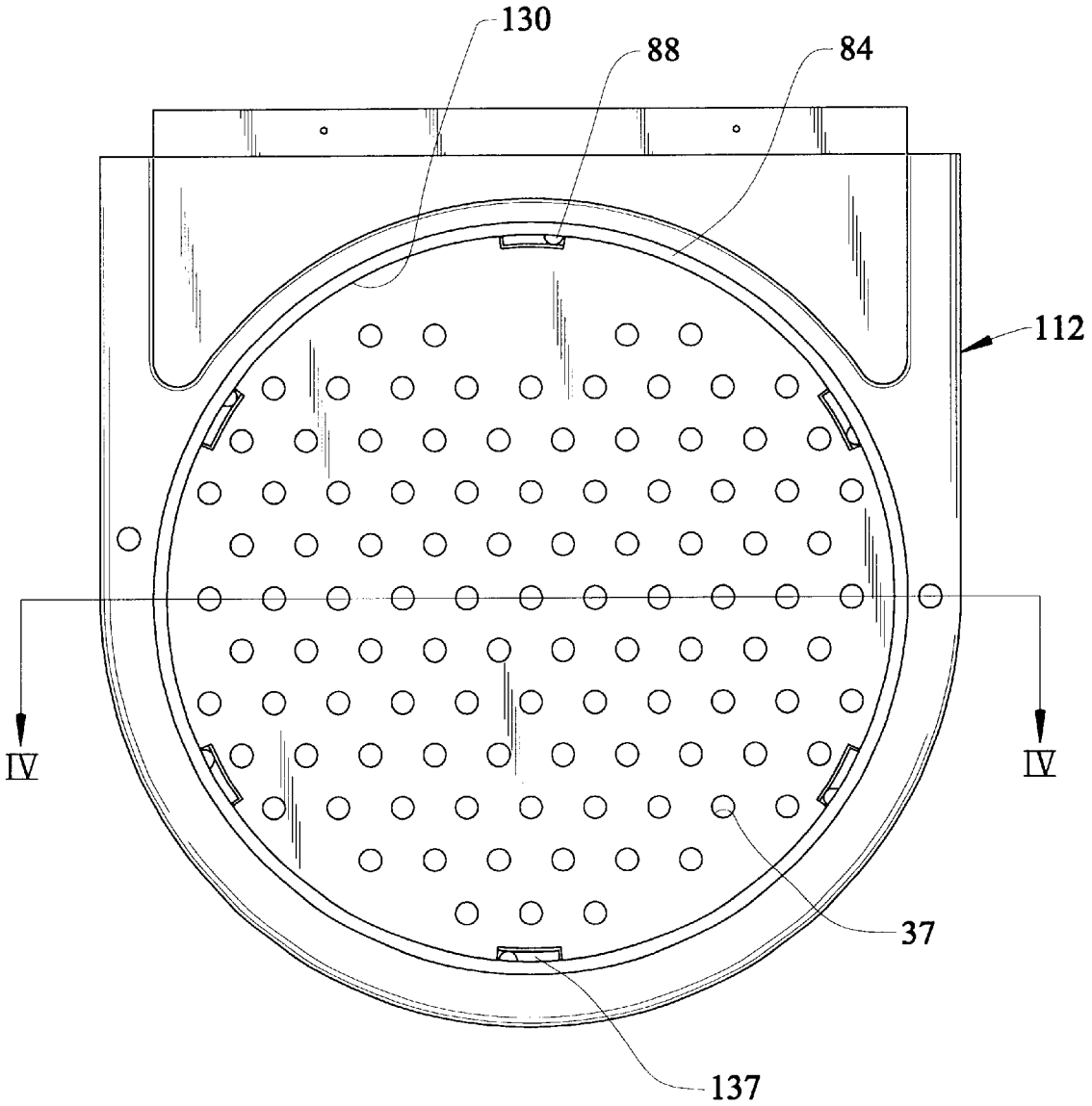
FIG. 3 is a plan view of an upper air delivery section of the air channel assembly opening into the, oven cavity of the cooking appliance.

With initial reference to FIGS. 1–3, a cooking appliance 1 is schematically shown in the form of a wall oven. Appliance 1 includes an oven cavity 5 generally defined by a bottom wall 8, a top wall 9, a rear wall 10 and a pair of side walls, one of which is indicated at 11. Oven cavity 5 also has associated therewith an access opening 13 for food items to be placed into or withdrawn from cavity 5. About access opening 13 is provided a frontal plate 16. In a manner known in the art, frontal plate 16 is adapted to be mounted against a substantially vertical wall such as in the kitchen of a residential home, and would have a door (not shown) pivotally attached thereto for selectively sealing off access opening 13.

Extending generally along top, bottom and rear portions of cavity 5 is an air channel assembly 26 defined by ducting that leads into and out of cavity 5. More specifically, air channel assembly 26 includes a lower air return section 29, an upper air delivery section 30 and a rear air transfer section 31. Lower air return section 29 is open into cavity 5 through a substantially central return air outlet 33 formed in bottom 8. In the most preferred form of the invention, return air outlet 33 is constituted by a generally circular insert provided with various spaced holes (not shown). In a similar manner, upper air delivery section 30 includes a discharge or delivery inlet 35 formed in top wall 9. Although only partially shown in FIG. 1, inlet 35 is also preferably constituted by a generally circular-shaped insert which is attached to the remainder of upper air delivery section 30 and which is provided with a plurality of holes 37.

As will become more fully evident below, the particular construction of cooking appliance 1 can significantly vary in accordance with the present invention. It is important in accordance with the present invention that cooking appliance 1 include an air channel assembly, such as that discussed above with reference to assembly 26, as well as a blower assembly, such as that generally indicated at 40, for use in generating a circulating flow of air through oven cavity 5. In the preferred embodiment shown, cooking appliance 1 constitutes an electric appliance and, more specifically, a combination convection, microwave and radiant cooking device. As shown in this figure, cooking appliance 1 is provided with an annular filter basket 46, having a multitude of circumferentially spaced holes 47, which is positioned within lower air return section 29 and through which the air flowing from cavity 5 through return air outlet 33 is directed. Arranged below filter basket 46 is a microwave generator unit 48 incorporating a magnetron (not specifically shown).

Encircling at least a portion of filter basket 46 is a first electric heating element 52. Heating unit 52 is shown as constituted by a sheathed electric resistance heating element having upper and lower interconnected legs 53 and 54. First electric heating unit 52 is preferably provided to heat return air flowing from oven cavity 5, through outlet 33 and filter basket 56 prior to the air reaching a catalyst indicated at 57. In a manner known in the art, catalyst 57 functions to eliminate smoke and the like from the air stream. As shown, catalyst 57 extends partially within a rotatable blower element 60 which forms part of blower assembly 40. Although blower element 60 can take various forms while performing the desired air flow generating function, blower element 60 preferably constitutes a centrifugal unit arranged at the juncture of lower air return section 29 and rear air transfer section 31. In general, blower element 60 is secured to a shaft member 62 that is rotatably mounted through a bearing assembly 64. Shaft member 62 also has attached thereto, for non-relative rotation, a sheave 66 which is adapted to receive a belt (not shown) for use in rotating blower element 60 through shaft member 62 in combination with an electric motor (also not shown). As illustrated, sheave 66 is preferably arranged within a housing extension 68 which projects from rear air transfer section 31.

Preferably mounted in upper air delivery section 30 adjacent rear transfer section 31 is a second electric heating element arrangement 70 that is preferably constituted by a bank of open heating coils. Most preferably, second heating unit 70 is defined by a single open electric coil arranged in multiple rows, with each row running back and forth across essentially the entire width of upper air delivery section 30 so as to be substantially perpendicular to the direction of flow through upper air delivery section 30. In any event, second heating unit 70 functions to further heat the air flowing through channel assembly 26 prior to the air reaching discharge inlet 35 as will be more fully discussed below.

Also shown in this figure is a third electric heating unit 72 which, in a manner similar to first electric heating unit 52, is preferably constituted by a sheathed, resistance-type heating element. Third electric heating unit 72 preferably extends adjacent top wall 9 and constitutes an additional heat source for cavity 5 of cooking appliance 1. The particular manner in which first, second and third electric heating units 52, 70 and 72 are utilized during operation of cooking appliance 1 for a cleaning mode of operation is detailed in U.S. patent application entitled "SELF-CLEANING SYSTEM FOR A COOKING APPLIANCE" filed on even date herewith and incorporated by reference. Furthermore, the preferred manner in which cooking appliance 1 is operated in other heating modes based, at least in part, from signals received from a temperature sensor 75 arranged in air channel assembly 26, is detailed in U.S. patent application entitled "HEATING SYSTEM FOR A COOKING APPLIANCE" filed on even date herewith and incorporated by reference.

Figure 5:
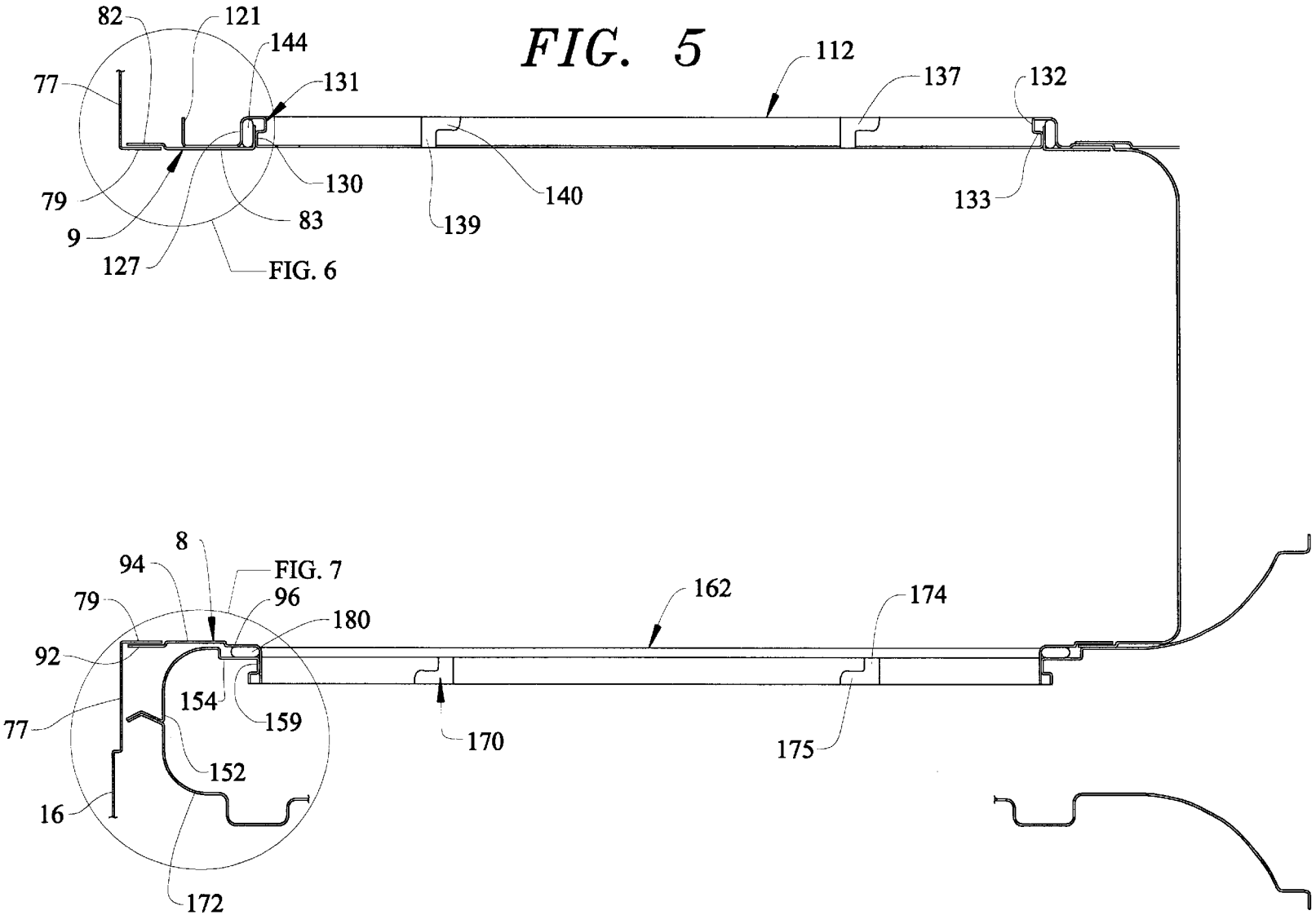
FIG. 5 is a partial side view of the oven cavity and a portion of the air channel assembly of FIG. 1.
Figure 6:
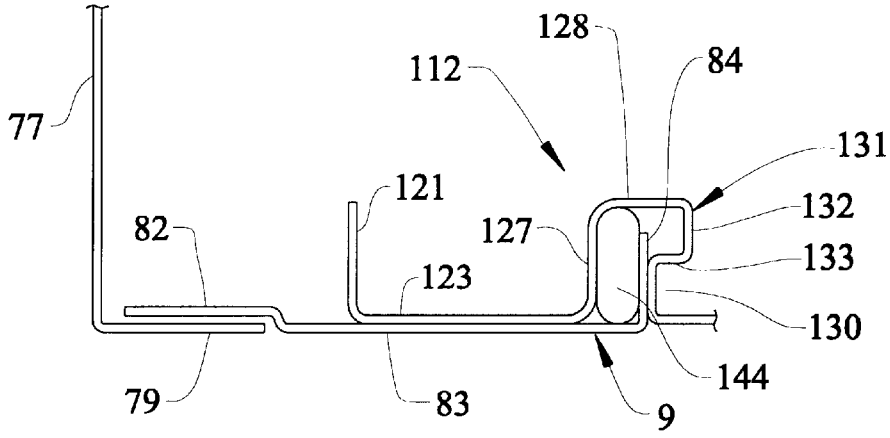
FIG. 6 is an enlarged view of an upper connection portion between the oven cavity and the air channel assembly of FIG. 5.

The present invention is directed to the construction of the oven cavity 5 and, more particularly, the manner in which air channel assembly 26 is interconnected to and arranged in fluid communication with oven cavity 5. With initial reference to FIGS. 1, 2, 5 and 6, frontal plate 16 is shown to include a face portion 77 which extends directly about and defines access opening 13. Face portion 77 leads to an inturned portion 79 that defines, at least in part, a portion of each of bottom, top and side walls 8, 9 and 11. At top wall 9 of oven cavity 5, inturned portion 79 is secured to, preferably by welding, an upper frontal edge portion 82 of top wall 9 as best shown in FIG. 6. Upper frontal edge portion 82 is offset from a rearwardly extending portion 83 of top wall 9. Rearwardly extending portion 83, in turn, terminates in an upturned flange 84. Upturned flange 84 defines an opening (not separately labeled) formed in top wall 9 for upper air delivery section 30. In accordance with the invention, this opening is circular in shape, generally in the order of 12–15 inches (approximately 30.5–38 cm) in diameter. For reasons which will be fully described below, upturned flange 84, which is preferably formed of sheet metal, is provided with various circumferentially spaced and radially inwardly extending projections or nubs 88 as best shown in FIG. 3.

With particular reference to FIGS. 1, 2, 5 and 7, face portion 77 is also attached to a lower frontal edge portion 92 of bottom wall 8. From lower frontal edge portion 92, bottom wall 8 leads into a rearwardly extending portion 94 which is offset from lower frontal edge portion 92 and generally coplanar with inturned portion 79. Rearwardly extending portion 94 is formed integral with a rear offset portion 96 which terminates in a down-turned flange 98. Down-turned flange 98 defines an opening (not separately labeled) which aids in defining return air outlet 33. In a manner analogous to the opening in top wall 9, this opening in bottom wall 8 is preferably circular in shape and generally in the order of 12–15 inches (approximately 30.5–38 cm) in diameter. Furthermore, in a manner directly analogous to upturned flange 84, down-turned flange 98 is also provided with a plurality of projections or nubs (not shown) projecting radially inwardly therefrom.

Figure 4:
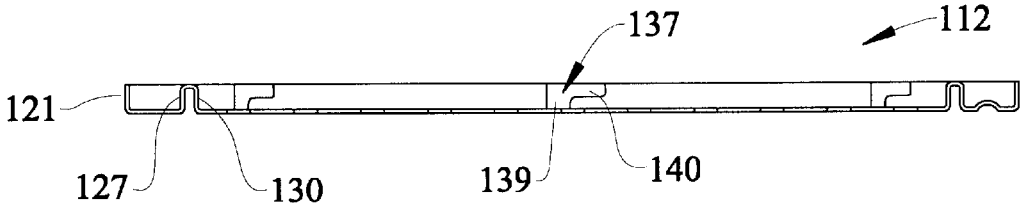
FIG. 4 is a cross-sectional view generally taken across line IV—IV in FIG. 3, showing the air delivery section.

In accordance with the most preferred form of the invention, upper air delivery section 30 is actually formed of various interconnected members. Although the particular construction could widely vary, upper air delivery section 30 is shown to include an uppermost hood portion 102 which leads to a cover piece 105 for second heating unit 70 and then to rear air transfer section 31. Upper air delivery section 30 also includes a lower panel portion 112 (see FIGS. 1, 3, 4 and 5) having a circular, generally central section which is adapted to be inserted into the opening in top wall 9. FIGS. 4 and 6 perhaps best depict the preferred construction of lower panel portion 112 which generally includes an outer upstanding flange 121, a first radial portion 123, an intermediate flange 127, a second radial portion 128 and an inner flange 130. Inner flange 130 is joined to second radial portion 128 by an offset section 131, including a generally vertical leg 132 and a generally horizontal leg 133. Annularly spaced about inner flange 130 are a plurality of slots 137 as best seen in FIGS. 3–5. Preferably, each slot 137 is generally L-shaped in that each slot 137 includes first and second, generally perpendicularly arranged segments 139 and 140.

With this arrangement, upper air delivery section 30 can be pre-assembled and attached to top wall 9 of oven cavity 5 generally through a bayonet-type connection. More specifically, although FIG. 5 only depicts the attachment of lower panel portion 112 to top wall 9, the most preferred embodiment of the invention has the entire upper air delivery section 30 assembled as a unit which is then positioned over the top wall 9 and the delivery inlet 35. An annular, preferably wire gasket 144 is positioned about upturned flange 84 as best shown in FIG. 6. Thereafter, when lower panel portion 112 is positioned upon top wall 9, wire gasket 144 is sandwiched between upturned flange 84 and intermediate flange 127. At the same time, inner flange 130 abuts an opposing side of upturned flange 84. During the initial assembly, each projection 88 extends within a respective slot segment 139. Once lower panel portion 112 is properly seated, the upper air delivery section 30 is slightly rotated or twisted so that each projection 88 shifts into a respective slot segment 140. In this manner, upper air delivery section 30 is locked to oven cavity 5 through a quick latching arrangement, with holes 37 fluidly communicating upper air delivery section 30 of air channel assembly 26 with oven cavity 5.

Figure 7:
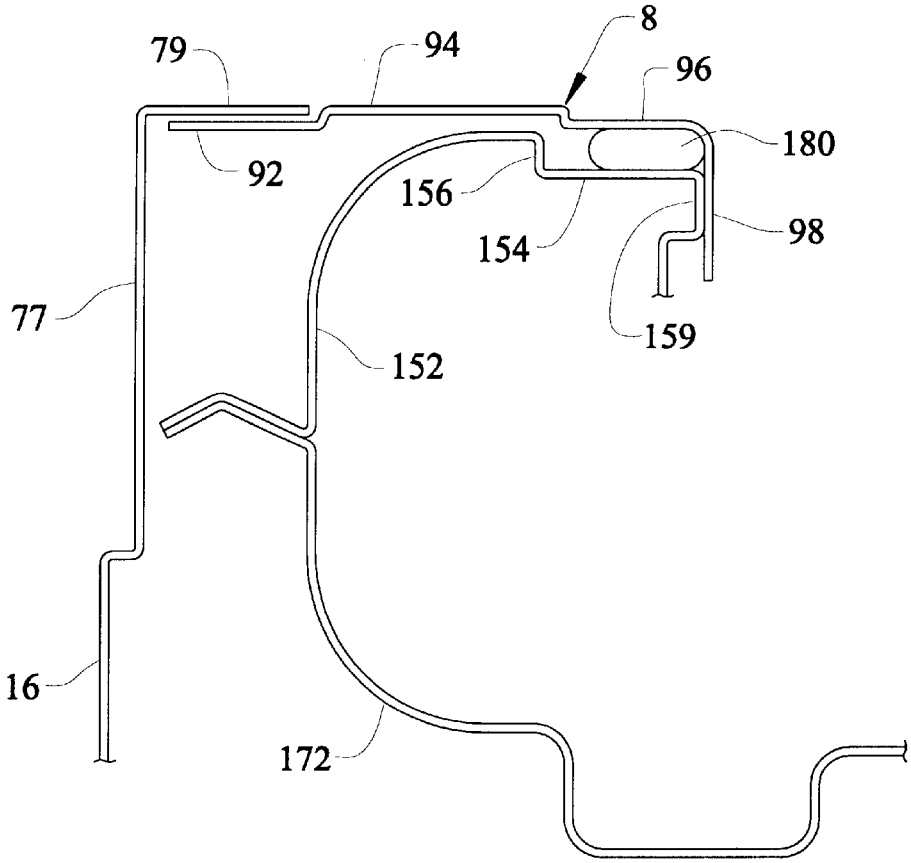
FIG. 7 is an enlarged view of a lower connection portion between the oven cavity and the air channel assembly of FIG. 5.

In a similar manner, lower return section 29 of air channel assembly 26 is attached to bottom wall 8. More specifically, lower air return section 29 includes an arcuate portion 152 which leads to a ledge portion 154 through a connecting section 156, as best shown in FIG. 7. Ledge portion 154 leads to a down-turned portion 159 which, as shown in FIG. 5, forms part of a circular insert section 162. Insert section 162 has an upstanding wall (not separately labeled) formed with various L-shaped slots 170. As with upper air delivery section 30, lower air return section 29, which also includes a lowermost duct portion 172, is preferably pre-assembled and then section 162 is inserted within the opening defined by down-turned flange 98 with each projection (not labeled) on flange 98 initially extending within a slot segment 174 of a respective L-shaped slot 170. Thereafter, lower air return section 29 is slightly rotated or twisted such that the projections shift to the respective slot segments 175. Therefore, in this manner, lower air return section 29 is fitted to bottom wall 8 of oven cavity 5 through a quick latching arrangement which preferably takes the form of a bayonet-type connection. Furthermore, interposed between rear offset portion 96 and ledge portion 154 is a wire gasket 180 that extends annularly about return air outlet 33.

Once lower air return section 29 and upper air delivery section 30 are attached to oven cavity 5 in the manner described above, sections 29 and 30 are then joined to rear air transfer section 31 by any means known in the art, such as through the use of welding or mechanical fasteners. In any event, with this arrangement, it should be readily seen that various portions of air channel assembly 26 can be pre-assembled and readily interconnected to oven cavity 5 in a quick and efficient manner. The use of bayonet-type connections are preferred in order to provide a generally positive locking arrangement between each of lower air return section 29 and upper air delivery section 30 with oven cavity 5. In addition, assembly personnel can readily verify the proper positioning of wire gaskets 144 and 180 such that a continuous ground path between the various components is assured in order to contain the energy produced during operation of microwave generator unit 48. In the most preferred embodiment of the invention, each wire gasket 144, 180 constitutes a circular, fine wire mesh, such as stainless steel, that is captured between the respective components with a compression fit.

Although the above-described arrangement constitutes the most preferred embodiment of the invention, it should be readily understood that various changes and/or modifications can be made to the invention without departing from the spirit thereof. In the most preferred embodiment, an annular recessed ledge 185 is created at return air outlet 33, as best shown in FIG. 1, which is adapted to support a ceramic base plate (not shown) within oven cavity 5. In any event, it should be realized that other forms of quick latching arrangements could readily be incorporated in accordance with the invention. In addition, the actual number, shape and interconnection of the various components could also be modified while still employing the use of the grounding gaskets and the quick latching connections. Therefore, in general, the invention is only intended to be limited by the scope of the following claims.

We claim:

1. A convection cooking appliance comprising:

an oven cavity including top, bottom, rear and opposing sidewalls, said oven cavity having an open frontal portion for accessing an interior of the oven cavity; and an air channel assembly extending about at least a portion of the oven cavity, said air channel assembly including an air delivery section opening into the oven cavity and an air return section leaving from the oven cavity, each of the air delivery section and the air return section being attached to the oven cavity through a quick latching connection, wherein the quick latching connection constitutes a twist lock.

2. The convection cooking appliance according to claim 1, wherein the oven cavity is formed with an enlarged opening in one of the top, bottom, rear and opposing sidewalls, said air delivery section being attached to the oven cavity about the enlarged opening.

3. The convection cooking appliance according to claim 2, wherein the enlarged opening is formed in the top wall.

4. The convection cooking appliance according to claim 3, wherein the enlarged opening is generally circular.

5. The convection cooking appliance according to claim 3, wherein the enlarged opening is defined by a peripheral flange, with the air delivery section being interconnected to the oven cavity at the peripheral flange.

6. The convection cooking appliance according to claim 5, wherein the quick latching connection is constituted by a bayonet-type connection.

7. The convection cooking appliance according to claim 6, wherein the bayonet-type connection includes a plurality of spaced projections extending from the peripheral flange and a plurality of slots formed in part of the air delivery section, said projections being received within said slots upon interconnecting the air delivery section to the oven cavity.

8. The convection cooking appliance according to claim 7, wherein each of said slots is generally L-shaped.

9. The convection cooking appliance according to claim 1, wherein the air delivery section extends across a substantial portion of the top of the oven cavity and the air return section extends along at least one of the bottom and rear of the oven cavity.

10. The convection cooking appliance according to claim 9, wherein each of the air delivery and air return sections defines, in combination with portions of the oven cavity, ducting extending about the at least one portion of the oven cavity.

11. A convection cooking appliance comprising:

an oven cavity including top, bottom, rear and opposing sidewalls, said oven cavity having an open frontal portion for accessing an interior of the oven cavity and being formed with an enlarged opening in one of the top, bottom, rear and opposing sidewalls; and an air channel assembly extending about at least a portion of the oven cavity, said air channel assembly including an air delivery section opening into the oven cavity and an air return section leaving from the oven cavity, said air delivery section being attached to the oven cavity about the enlarged opening, at least one of the air delivery section and the air return section being attached to the oven cavity through a quick latching connection;

a blower in fluid communication with the air channel assembly; and a microwave generating unit .supported by the air channel assembly.

12. The convection cooking appliance according to claim 11, wherein the quick latching connection constitutes a twist lock.

13. The convection cooking appliance according to claim 11, further comprising: a gasket interposed between the air channel assembly and the oven cavity adjacent the quick latching connection.

14. The convection cooking appliance according to claim 13, wherein the gasket is formed of metal.

15. The convection cooking appliance according to claim 14, wherein the gasket comprises a wire mesh.

16. A convection cooking appliance comprising:

an oven cavity including top, bottom. rear and opposing sidewalls, said oven cavity having an open frontal portion for accessing an interior of the oven cavity;

an air channel assembly extending about at least a portion of the oven cavity, said air channel assembly including an air delivery section opening into the oven cavity and an air return section leaving from the oven cavity;

a microwave generating unit for developing microwaves directed into the oven cavity, said microwave generating unit being supported by the air channel assembly; and at least one gasket, made from a conductive material, interposed between the air channel assembly and the oven cavity.

17. The convection cooking appliance according to claim 16, wherein the gasket comprises a wire mesh.

18. The convection cooking appliance according to claim 17, further comprising: a blower, said blower being in fluid communication with the air channel assembly.

19. The convection cooking appliance according to claim 16, wherein the oven cavity is formed with an enlarged opening in one of the top, bottom, rear and opposing sidewalls, said air delivery section being attached to the oven cavity about the enlarged opening.

20. The convection cooking appliance according to claim 19, wherein at least one of the air delivery section and the air return section is attached to the oven cavity through a quick latching connection.

21. The convection cooking appliance according to claim 20, wherein the quick latching connection constitutes a twist lock.

22. The convection cooking appliance according to claim 21, wherein the quick latching connection is constituted by a bayonet-type connection.

23. The convection cooking appliance according to claim 16, wherein the air delivery section extends across a substantial portion of the top of the oven cavity and the air return section extends along at least one of the bottom and rear of the oven cavity.

24. The convection cooking appliance according to claim 23, wherein each of the air delivery and air return sections defines, in combination with portions of the oven cavity, ducting extending about the at least one portion of the oven cavity.

25. A method of attaching an air channel assembly to an oven cavity of a convection cooking appliance comprising;

forming the oven cavity with both an air delivery opening and an air return opening;

forming the air channel assembly with both an air delivery section and a return section; and attaching each of the air delivery section at the air delivery opening and the return section at the return opening through a quick latching connection, wherein the air delivery section is attached to the oven cavity through a twist lock.

26. A method of attaching an air channel assembly to an oven cavity of a convection cooking appliance comprising:

forming the oven cavity with both an air delivery opening and an air return opening;

forming the air channel assembly with both an air delivery section and a return section;

attaching at least one of the air delivery section at the air delivery opening and the return section at the return opening through a quick latching connection;

providing a microwave unit supported by the air channel assembly; and interposing at least one metal gasket between the air channel assembly and the oven cavity to provide a continuous ground path to contain microwave energy generated by the microwave unit.

27. The method according to claim 26, wherein the air delivery section is attached to the oven cavity through a twist lock.

28. The method of according to claim 26, wherein the at least one gasket is compression fit between the air channel assembly and the oven cavity.

* * * * *